US005785564A

United States Patent [19]

Von Ohain et al.

[11] Patent Number: 5,785,564

[45] Date of Patent: Jul. 28, 1998

[54] WATER CRAFT WITH A HYDROFOIL-BLADED WHEEL ASSEMBLY

[76] Inventors: Hans J. Von Ohain, 3305 Nan Pablo Dr., Melbourne, Fla. 32934; Christopher H. Von Ohain, 31 Carpenters Run, Cincinnati, Ohio 45241

[21] Appl. No.: 880,788

[22] Filed: Jun. 23, 1997

[51] Int. Cl.[6] ..... B63H 1/04

[52] U.S. Cl. ..... 440/90; 114/274

[58] Field of Search ..... 440/90, 91, 92, 440/96, 274, 271, 280, 66

[56] References Cited

U.S. PATENT DOCUMENTS

| | | | |
|---|---|---|---|
| 2,294,104 | 8/1942 | Waddington . | |
| 2,315,027 | 3/1943 | Svenson . | |
| 2,404,044 | 7/1946 | Falk | 440/90 |
| 3,027,863 | 4/1962 | Town . | |
| 3,251,334 | 5/1966 | Beardsley | 440/90 |
| 3,467,049 | 9/1969 | Turcotte . | |
| 4,473,358 | 9/1984 | Viosca, Jr. . | |
| 4,772,237 | 9/1988 | Zalkauskas . | |

*Primary Examiner*—Stephen Avila
*Attorney, Agent, or Firm*—Charles R. Wilson

[57] ABSTRACT

A self-propelled water craft includes a hydrofoil-bladed wheel assembly which allows an individual to propel the water craft through the water at a relatively high speed. The assembly comprises an open frame with attachment means for securing to a stern of the water craft's boat hull, a drive shaft rotatably mounted on the open frame, at least one bladed wheel permanently secured to the shaft to rotate with the shaft, and a hydrofoil mounted on the open frame directly below the bladed wheel. The blades are mounted on the periphery of each wheel and are angled backwardly. The blades are also curved. As the blades move through water they force water flow over the hydrofoil in a manner which propels the water craft forwardly and provides the proper lift to the water craft so as to lessen water resistance against the boat hull.

28 Claims, 6 Drawing Sheets

WATER CRAFT WITH A HYDROFOIL-BLADED WHEEL ASSEMBLY

This invention relates to a water craft. More particularly, the invention relates to a self-propelled pleasure water craft which is capable of moving through the water at a relatively high speed.

BACKGROUND OF THE INVENTION

Outdoor activities in general are becoming more popular as people become more health conscience. More recently, the use of weekend and summer vacation homes has grown in popularity. The home-away-from-home gives the owner a chance to be away from it all. Biking and hiking are very popular with this group of people. Given the fact many of the vacation homes are found near a lake, it is not surprising that boating also is a very popular form of outdoor activity among the vacation home enthusiasts. Boating includes all types of water craft, including row boats, paddle boats, hydrofoil boats, sail boats, inboard and outboard motor boats and small yachts. The costs and skills involved are very dependent on the type of craft one chooses.

Some individuals enjoy the thrill of speeding across water in a water craft and perhaps racing against another individual. A self-propelled water craft used for this purpose can be exhilarating. Water craft such as row boats and canoes are two very popular self-propelled boat types which are widely used. They require primarily arm and shoulder strength to propel them and ordinarily the individual must be in near top physical condition.

Paddle boats have become more popular in recent years. They require primarily leg strength and generally the individual need not be in as good as physical condition as the rowers. U.S. Pat. Nos. 3,027,863, 3,467,049 and 4,772,237 contain descriptions of paddle boats. The known paddle boats, though, are inefficient in operation. All known paddle boats have planar paddles mounted on rotating wheels or bands which plow through the water to provide a forward propulsive force. They are not made for speed racing. While enjoyable, they simply do not provide a thrill to the boating enthusiast who enjoys speeding through the water.

Hydrofoil water crafts have enjoyed limited popularity. They all have an underwater elongated body with a configuration which provides a lifting force. The boat hull has sufficient buoyancy to float when at rest. Yet, when in operation and moving beyond a critical speed, action of water on the hydrofoil raises the boat hull so that it no longer engages the water. This, of course, substantially reduces drag on the boat hull and allows it to move faster through the water. Such boats can be self-propelled or motor driven. U.S. Pat. Nos. 2,294,104, 2,315,027, 4,349,340 and 4,473,358 describe hydrofoil boats which have foot operated drive means to propel the boat through the water. They require the operator to have about the same physical conditioning as paddle boats, but do move faster through the water. The known self-propelled hydrofoil boats are complicated in design and are costly to produce and maintain.

There has now been developed a self-propelled i.e. human powered fast moving water craft which is propelled by leg power, arm power, or both leg and arm power. The water craft of the invention is capable of relatively fast speeds through the water, unlike conventional paddle boats, row boats, kayaks, and similar crafts. The water craft is economical to produce, requires only an ordinary effort to operate and is easy to maintain. Very importantly, it is highly efficient in that sustained human power output is a fraction of horsepower thereby lending itself to high speeds for substantial time intervals. It fills a need in an ever increasingly popular outdoor sport.

SUMMARY OF THE INVENTION

A self-propelled water craft comprises a boat hull, a hydrofoil-bladed wheel assembly and a power transmission system. The hydrofoil-bladed wheel assembly comprises an open frame with attachment means for securing to a stern of the water craft's boat hull, a drive shaft rotatably mounted on the open frame, at least one bladed wheel permanently secured to the shaft to rotate with the shaft, and a hydrofoil mounted on the open frame directly below the bladed wheel. The blades are mounted on the periphery of each wheel. Each blade is angled backwardly and curved to provide a scoop surface for optimum capturing of water. The power transmission system transfers power from the individual to rotate the drive shaft and the bladed wheel. As the blades move through the water, they force water over the hydrofoil in a manner which efficiently provides a forward propulsive force and provides lift to the water craft so as to lessen water resistance against the boat hull.

BRIEF DESCRIPTION OF THE INVENTION

DETAILED DESCRIPTION OF THE INVENTION

Figure 1:
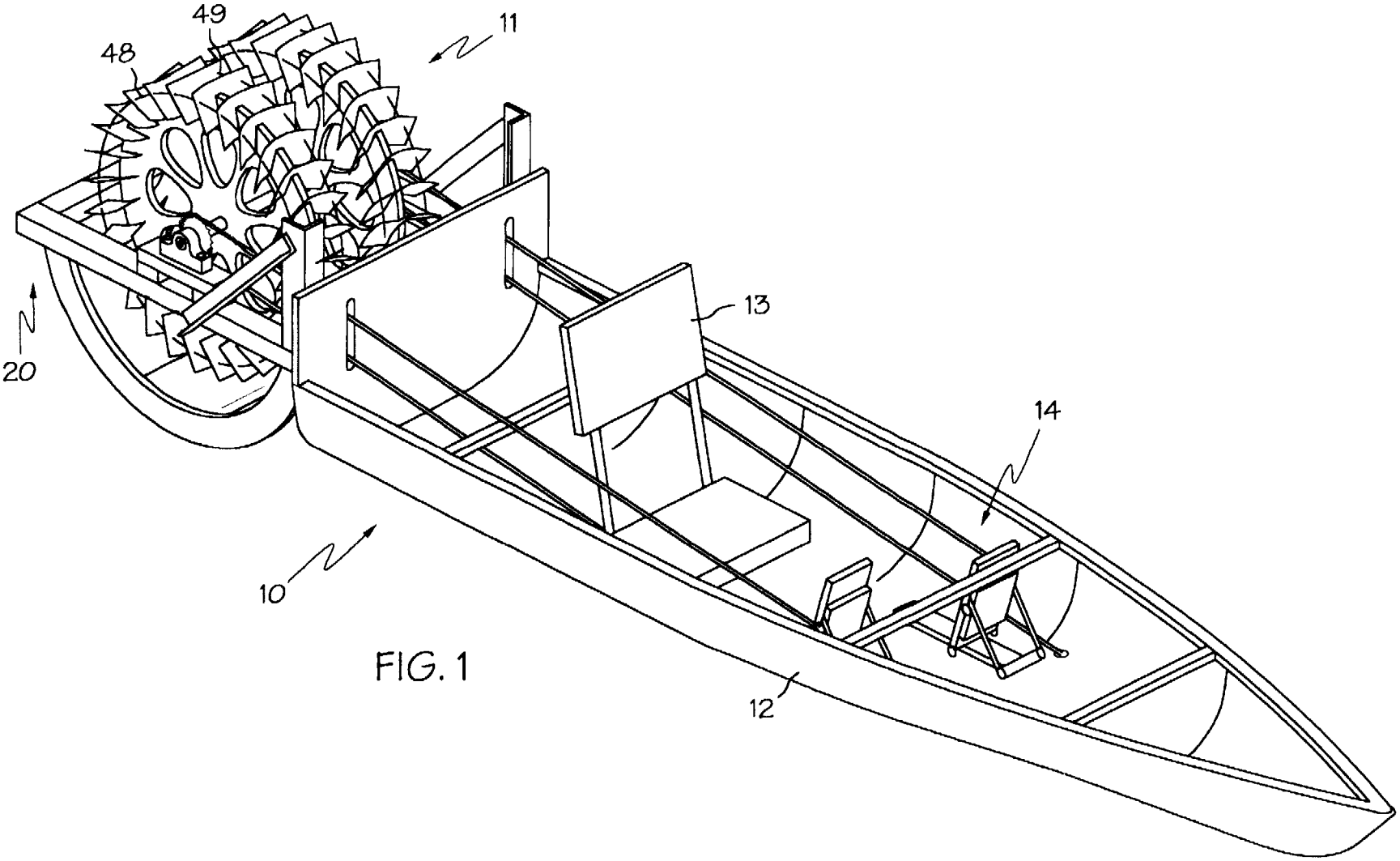
FIG. 1 is a perspective view of a self-propelled water craft of the invention. 5

With reference to FIG. 1, there is shown a self-propelled water craft 10 having a hydrofoil-bladed wheel assembly 11 of the invention. The water craft 10 is a single person craft having an elongated boat hull 12, an operator's seat 13 for the individual and a power transmission system 14 for transferring power supplied by the individual to the hydrofoil-bladed wheel assembly 11.

Figure 2:
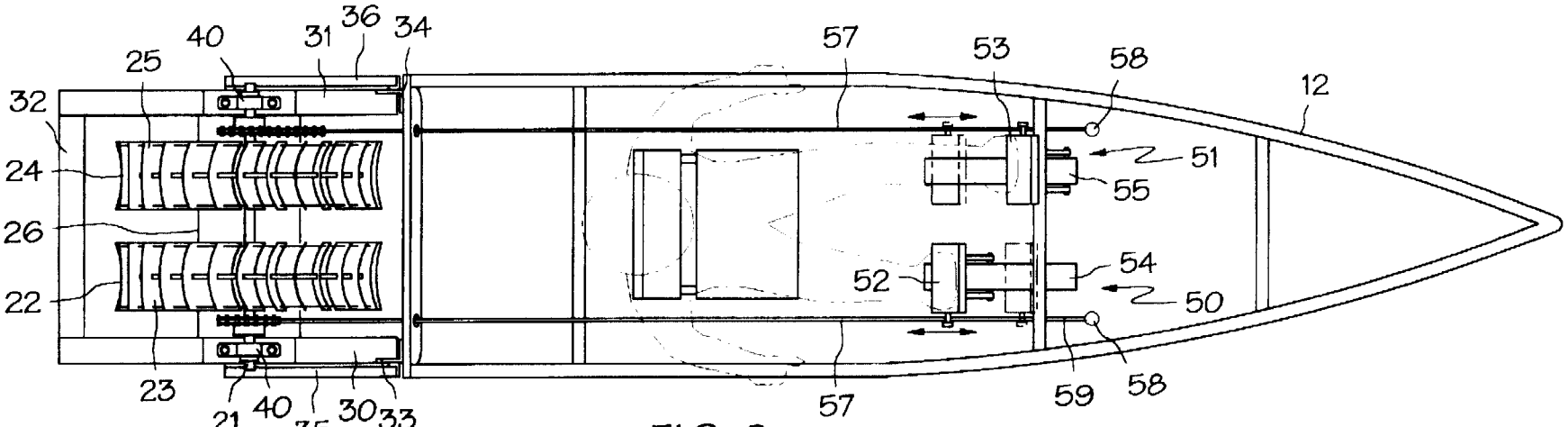
FIG. 2 is a top plan view of the self-propelled water craft of FIG. 1.
Figure 3:
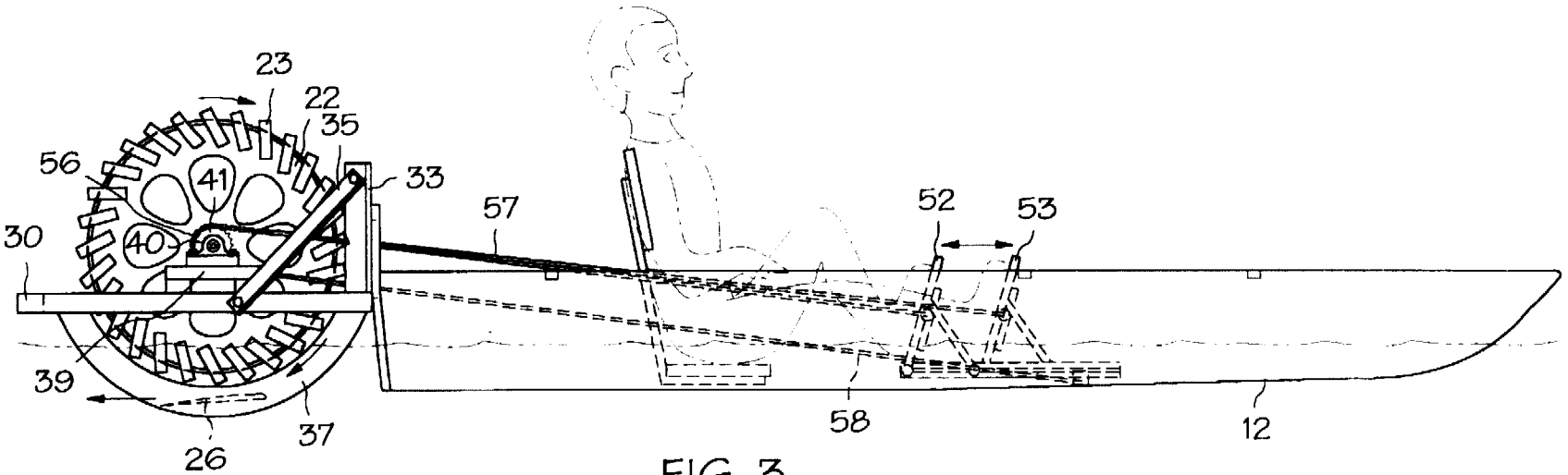
FIG. 3 is a side elevational view of the self-propelled water craft of FIG. 1.

The boat hull 12 of the water craft 10 depicted in FIGS. 1–3 is designed to reduce water drag on the hull as it moves through the water. It is a basic one-person boat hull which has been designed to receive the hydrofoil-bladed wheel assembly and to accommodate the power transmission system. The boat hull is preferably from about twelve feet to about sixteen feet long and about two and one-half feet to about three feet wide. It has a flattened stern and its sides are generally tapered towards the bow to lessen water resistance as the water craft moves through the water. The boat hull has a water line depth with an adult person of average weight inside of about four inches to about six inches. Boat hulls of many other shapes and sizes can be used. As shown, the operator's seat 13 for the individual is positioned near the approximate center of the boat hull for optimum operation.

The boat hull 12 is made from a fibrous reinforced resinous material in a known manner. Other materials commonly used in building water craft including Kevlar, wood and aluminum are feasible, though less preferred. The use of fibrous reinforced resinous material in the boat hull is an optimum blend of manufacturing cost, durability, weight, and maintenance.

Figure 7:
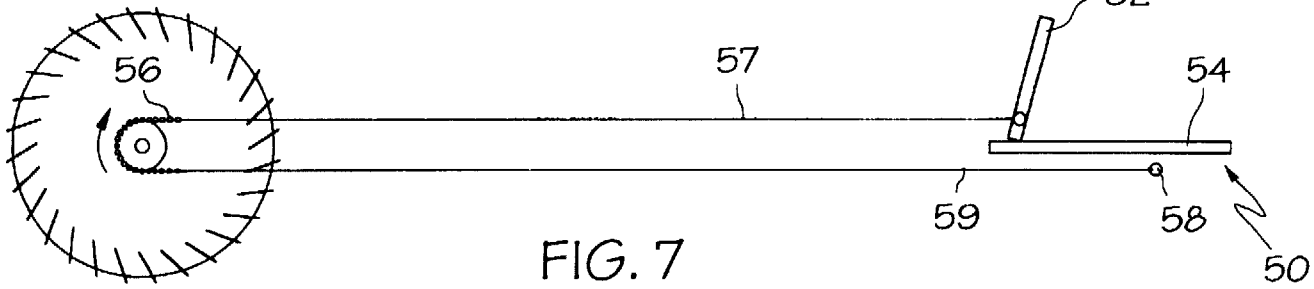
FIG. 7 is a schematic side view of a power transmission system used on a self-propelled water craft of the invention for transferring power from an individual to a bladed wheel.
Figure 8:
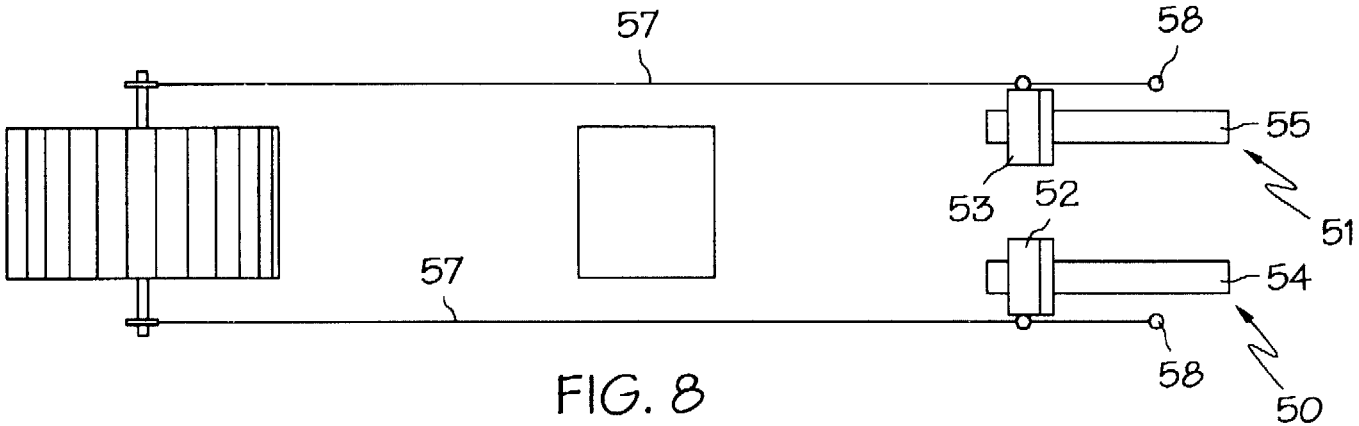
FIG. 8 is a schematic top view of the power transmission system of FIG. 7.
Figure 9:
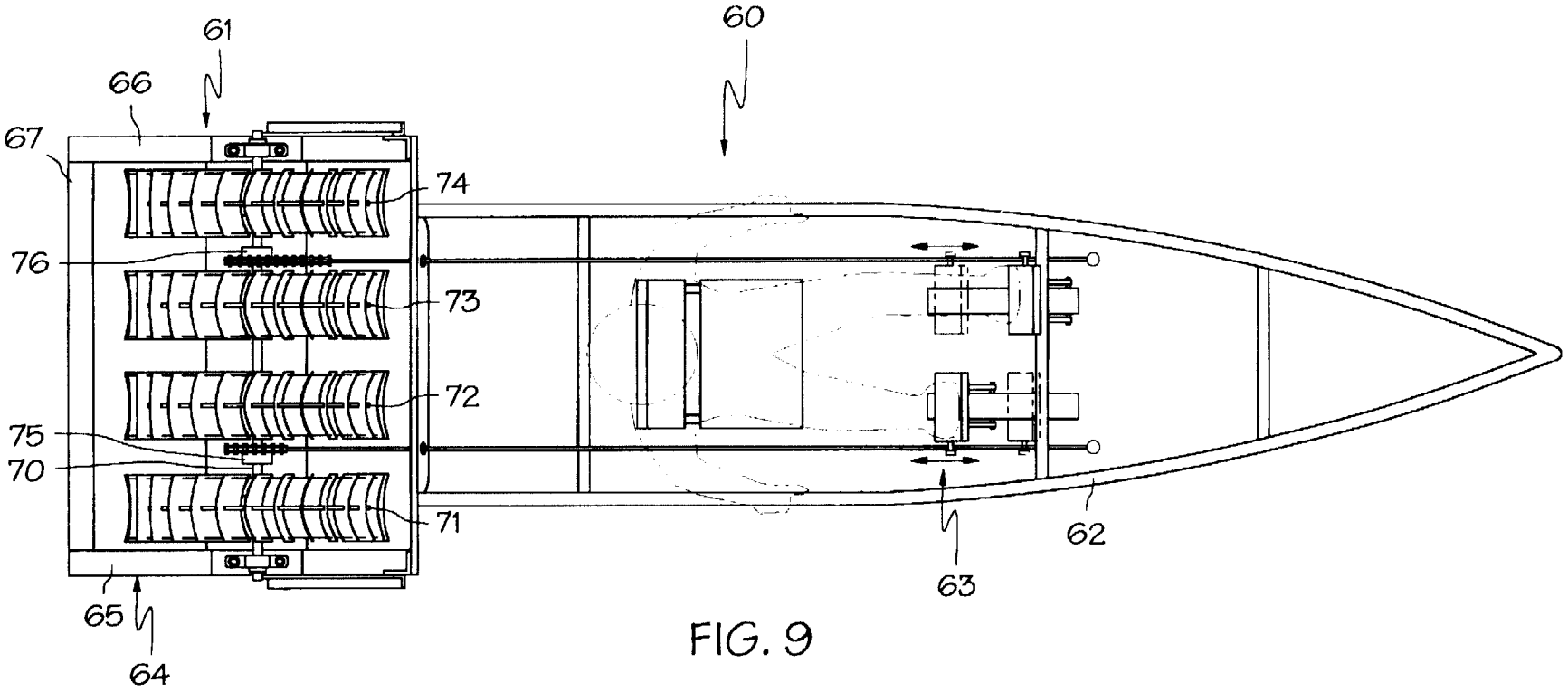
FIG. 9 is a top plan view of another self-propelled water craft of the invention with a hydrofoil-bladed wheel assembly wherein four bladed wheels are mounted on a single shaft.

The uniqueness of the water craft of the invention is the hydrofoil-bladed wheel assembly. As best seen in FIGS. 1–5, the hydrofoil-bladed wheel assembly 11 includes an open frame 20, a horizontally disposed drive shaft 21, a first wheel 22 with a set of curved blades 23 permanently mounted thereon, a second wheel 24 with a set of curved blades 25 permanently mounted thereon, and a substantially horizontally disposed hydrofoil 26. In accord with this invention, one wheel or multi-wheels, each with a set of blades, are used in the hydrofoil-bladed wheel assembly. As evident in FIGS. 1 and 2, the assembly 11 has two bladed wheels. FIGS. 7 and 8 depict a hydrofoil-bladed wheel assembly having a single wheel. FIG. 9 depicts a hydrofoil-bladed wheel assembly having four wheels. Generally speaking, the greater the number of bladed wheels, the more efficient the propulsion process. Hence, the faster the water craft can be made to move through the water. However, increased cost in producing the four wheel assembly as well as increased weight and bulk in the water craft are offsetting factors.

Referring again to FIGS. 1–5, the open frame 20 of the assembly 20 11 is configured to permanently hold the drive shaft 21 and its associated bladed wheels and to hold the hydrofoil 26. The open frame 20 has two substantially parallel side rails 30 and 31 and a cross rail 32 secured at an about right angles to ends of the side rails 30 and 31. A pair of upstanding mounting rails 33 and 34 at an opposite end of the side rails 30 and 31 each have an angled brace 35 and 36 extending from near the mounting rail's terminus to a mid-section of the side rails 30 and 31 for stability reasons. The mounting rails 33 and 34 are used to permanently attach the open frame to the stern of the boat hull. Conventional attachment means such as bolts and nuts are used. The open frame 20 also has two thin arcuate members 37 and 38 which extend down from one end of each side rail to an opposite end of the side rail. The lowermost point of each arcuate member is substantially vertically disposed from the drive shaft 21. The arcuate members 37 and 38 are used to properly position the hydrofoil 26 in relation to the blades on the wheels 22 and 24 as they move through the water. Given the fact the arcuate members are under water, their curved and thin nature are instrumental to reduced water resistance.

The open frame 20 also holds mounting blocks 39 and bearing blocks 40. The bearing blocks 40 receive the drive shaft 21 which in turn has free-wheeling sprockets 41 and 42 near each terminus. The sprockets and drive shaft are a part of the power transmission assembly which is further described below.

The wheels 22 and 24 with the curved blades 23 and 25, respectively, are identical in structure. For purposes of brevity, wheel 22 and curved blades 23 are discussed in detail, it being understood the same detail applies to the wheel 24 and associated curved blades 25. As evident in FIG. 6, the wheel 22 has a center hole 45 with a diameter approximate that of the drive shaft 21. The wheel 22 is immovably mounted on the drive shaft 21 at its center axis so as to rotate as the drive shaft rotates. The bladed wheel, i.e. the wheel and its blades, has a blade tip diameter of from about eighteen inches to about twenty-one inches. As seen in FIGS. 2 and 3, the wheel 22 is relatively thin, i.e. about one fourth inch in thickness. It is made of a rigid light-weight material. Acrylic plastic is preferred, though other plastics, metal and wood can be used. Cut-outs 46 are optionally provided to reduce the wheel's weight.

The curved blades 23 are circumferentially disposed on the periphery of the wheel 22 about the wheel's axis. Each blade 23 is permanently mounted on the wheel 22. For this purpose, a slot 47 (best seen in FIG. 4 wherein a blade has been removed for illustration purposes) substantially equal to the thickness of a blade is cut into the wheel's periphery. The slot's depth is sufficient to rigidly hold the blade. Each blade 23 is slipped into a slot 47 at the blade's vertical center-line and then fastened either mechanically or adhesively to remain in place. The blades are aligned and substantially equi-spaced with one another. Preferably, and with reference to FIG. 6, an outer stiffening wire 48 and an inner stiffening wire 49 extend through each blade near side edges thereof to add a degree of rigidity to the blades.

Generally, blades found on multi-wheel hydrofoil assemblies have chords of from about five inches to about seven inches and heights of from about two and one-half inches to about four inches. Blades found on single wheel hydrofoil assemblies will normally have a greater chord, but less then about twelve inches. As conventionally used, the chord is the shortest distance between side edges of the blade. The curved blades 23 found on the wheel 22 of the hydrofoil-bladed wheel assembly 11 have about six inch chords and about three inch heights.

Figure 6:
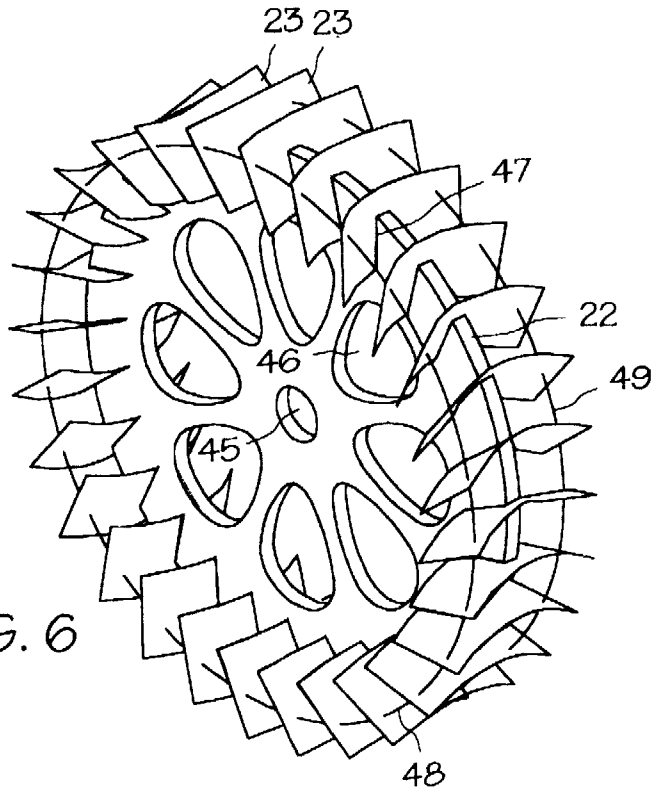
FIG. 6 is a perspective view of a bladed wheel forming a part of the hydrofoil-bladed wheel assembly of FIG. 1.

The shape of the blades 23 as best seen in FIG. 6 is curved in a two dimensional or cylindrical form. For even greater efficiency and performance gains, the blades are curved in a three dimensional shape where curvature is also imparted to the blade between the inner and outer longitudinal edges. For the multi-wheel hydrofoil assemblies, each blade 23 is curved to give a preferred radius of about three inches to about four inches to enhance its water movement capability as it is forced through the water by the rotating wheel 22. The blade's radius for this purpose can be routinely measured in the machine shop. It can also be calculated using the formula $r=w/2 \sin[90-\text{alpha}]$ where r is the radius, w is the width or chord of the blade and alpha is the entrance angle. A single wheel hydrofoil assembly has blades with a more gentle curve. In all embodiments, the curve is constant.

Figure 4:
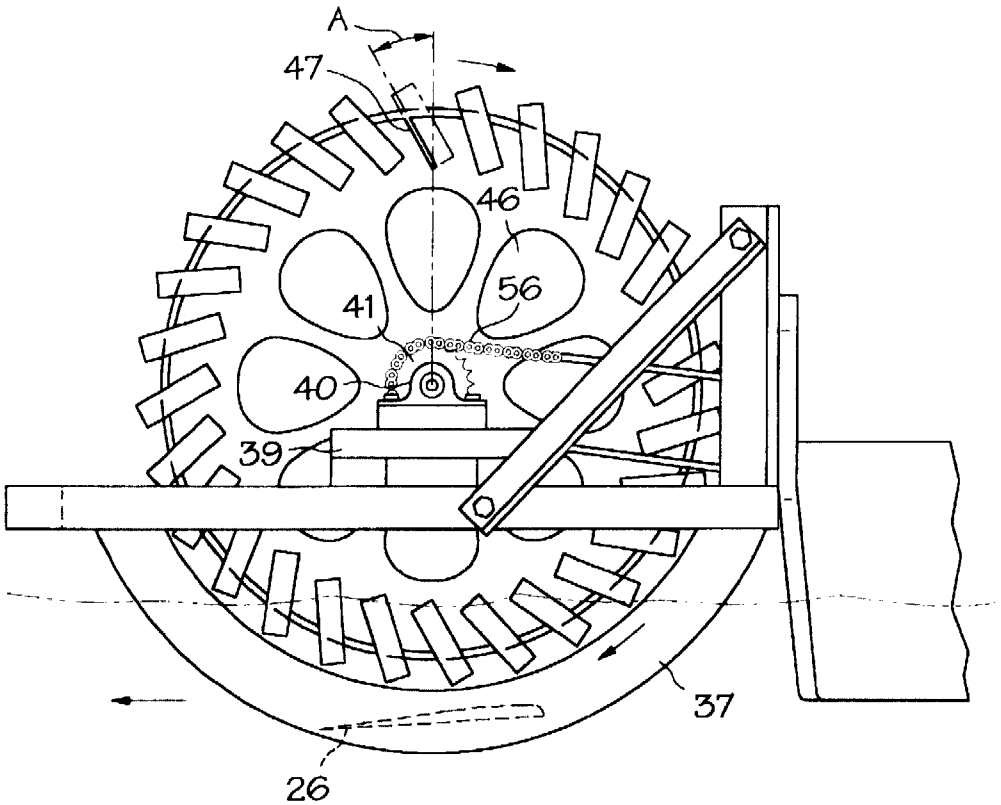
FIG. 4 is an enlarged side elevational view of a hydrofoil-bladed wheel assembly found on the self-propelled water craft of FIG. 1.

As evident in FIG. 4, each blade is also mounted on the wheel in the slot 47 at a backward angle of inclination A of about 20 degrees to about 30 degrees from a radius vector extending from the wheel's center axis. Preferably, the blade's backward angle of inclination is about 25 degrees from the radius vector. A backward angle of less than the about 20 degrees will give water movement performance approximately that of the blades on a convention paddle wheel. That is, the water movement is good on entry side, but bad on the exit side. A backward angle of greater than the about 30 degrees tends to nullify the effect from the hydrofoil and is avoided for this reason. For the illustrated twenty inch bladed wheel, there are twenty-four substantially equi-spaced blades 23 around its periphery. Generally, each wheel has from twenty to about twenty-four equi-spaced blades. Further, for the multi-wheel assemblies, there is a distance of about five inches to about seven inches between adjacent sets of blades on wheels.

The blades are made of a thin gauge aluminum. Other materials of construction can be used which are lightweight, sufficiently rigid, and be can be shaped properly e.g. stainless steel or plastic.

The hydrofoil 26 is attached to the arcuate members 37 and 38 of the open frame 20 and extends transversely thereacross such that its leading edge is parallel to the axis of the bladed wheels. It is an elongated structure. For all multi-wheel hydrofoil assemblies, the hydrofoil has a lateral length slightly greater than the total distance between outer lateral blade edges of outermost wheels. For a single wheel hydrofoil assembly, the hydrofoil has a lateral length approximately equal to its blades' chord. A chord, i.e. the straight line between leading and trailing edges of the hydrofoil 26 depends on the desired performance speed characteristic, though generally ranges from about two inches to about five inches. For a race craft, the chord is at or near the lower end of the range while for a cruising type craft it is at or near the upper end of the range. For versatility reasons, the assembly is designed to allow a ready exchange of hydrofoils primarily depending on the watercraft speed desired.

The arcuate members as aforedescribed, extend downwardly from the side rails a sufficient distance so that the hydrofoil 26 is about five to about six inches below the water surface when the hydrofoil is attached and the whole assembly on a boat hull put into the water. Furthermore, the hydrofoil 26 is about two inches to about three inches below the lowermost blade edge as each blade passes over the hydrofoil 26.

As best seen in FIG. 4, the hydrofoil 26 has a conventional profile with a substantially flat bottom surface (pressure side) and a convex upper surface (suction side). It has a cross-section which is tapered forwardly and inclined upwardly towards the boat hull. Furthermore, it has a rounded leading edge. Preferably, a positive angle less than about three degrees, more preferably about one degree to about two degrees of incline from the horizontal is used.

The hydrofoil serves several functions. Most importantly, it guides water exiting from the rotating bladed wheel or wheels toward the most suitable division between propulsive thrust and lift. The hydrofoil also protects the blades from contact with underwater objects such as sunken logs, etc. thereby preventing damage to the blades. It also prevents the blades from accidently contacting swimmers or animals which may be in the vicinity.

The power transmission system used with the water craft 10 is illustrated in FIGS. 1–3 and best depicted in schematic form in FIGS. 7 and 8. It comprises two linear motion foot slides 50 and 51 which are connected to the drive shaft 21 of the bladed wheel by an inelastic cable, sprocket chain and elastic cord arrangement. While other systems for transferring power from the individual to the bladed wheel can be used, the linear foot slides described below are highly preferred for performance reasons.

With particular reference to FIGS. 2, 7 and 8, the two linear foot slides 50 and 51 have substantially vertically extending footrests 52 and 53 slidably mounted on guide rails 54 and 55 attached to the boat hull directly in front of the operator's seat to receive the individual's feet when the legs are both fully extended and when the legs are substantially fully bent at the knee. Linear foot slides of this general nature are well known and are often used with home exercise devices. The inelastic cable, sprocket chain and elastic cord arrangement is the same for each foot slide and is numbered for foot slide 50 only. The sprocket chain 56, which has a length approximately equal to a stroke length, wraps around the free-wheeling sprocket 41 mounted on the drive shaft 21. The sprocket chain 56 can be longer, though preferably is not because of a resultant increase in weight. Necessarily, a heavier water craft is a slower moving water craft. The substantially inelastic cable 57 extends from the footrest 53 to one end of the sprocket chain. Rope, wire, wire cable or any other inelastic cable can be used. The elastic cord 59 extends from the other end of the sprocket chain 56 to a fixed structure such as a peg 58 in the boat hull near the footrest. The elastic cord 59 provides a return feature to the linear foot slides. Each foot slide operates independently of the other.

Other variations or enhancement possibilities based on the aforedescribed power transmission systems are feasible but less preferred for cost or performance reasons. For example, hand and arm power input through the attachment of hand grips on sliding rails to the inelastic cords is possible. A rolling seat with fixed foot pedals similar to conventional rowing systems wherein the seat is attached to the inelastic cords is usable. A conventional bicycle-type pedal assembly with foot pedals, drive sprocket, sprocket chain and driven sprocket connected to the drive shaft can also be used.

Figure 5:
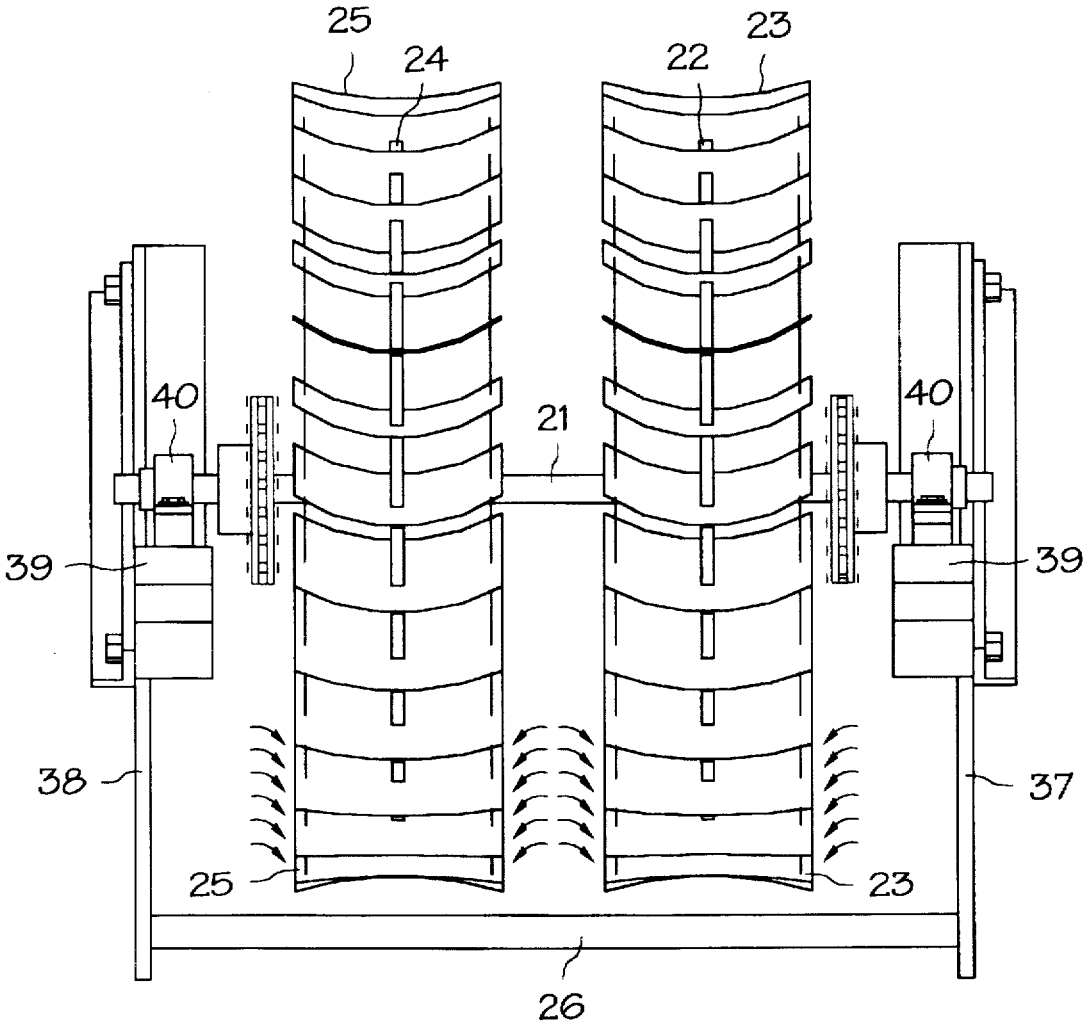
FIG. 5 is a back elevational view of the self-propelled water craft of FIG. 1 with a part of an open frame removed for clarity purposes.

An explanation of the principles responsible for the propulsion efficiency of the water craft of the invention is best explained with reference to FIG. 5. As the wheels 22 and 24 rotate, blades 23 and 25 on the wheels move through the water. Water flow channels are created directly behind each set of blades. Water enters into the flow channels through side edges of each blade in a direction parallel to the axis of the blade rows. Subsequently, the water within the flow channels turns from the axial direction into the radial outward flow direction. Finally, the water leaves through the outer longitudinal edge of the blades and reaches the upper surface of the hydrofoil 26. This energized water stream above the upper surface of the hydrofoil 26 prevents separation of a boundary layer at the hydrofoil upper surface over a large range of angle of attack, resulting in a favorable lift to drag (L/D) ratio. In effect, it is the blade placement, blade configuration, hydrofoil placement and hydrofoil configuration which cooperatively provide the good L/D ratio and a greater more effective propulsive force.

It should be noted, unlike conventional paddle wheels, the backwardly angled curved blades of the hydrofoil-bladed wheel assembly of the invention do not throw significant amounts of water above the water line as the blades exit the water. Therefore, power losses in vertically lifting water on the blades as they move upwardly and above the water line are avoided. Likewise, the hydrofoil also contributes to the assembly's efficiency by eliminating downward water flow losses as the backwardly angled blades enter the water.

FIG. 9 illustrates a water craft 60 of the invention having a hydrofoil-bladed wheel assembly 61 with four bladed wheels. The water craft 60 is especially capable of moving through the water at relatively high speeds. Greater efficiency and resulting speed is achieved by using multiple wheels because the depth of each wheel in the water can be smaller, thereby reducing downward propulsion forces and drag.

It should be understood that in determining proper wheel depth in water there is a trade-off between power generated and power lost. With one wheel, a greater water depth is needed to generate sufficient power. However, there are significant losses because of the additional downward forces and increased drag. By raising the wheel to a more shallow depth those losses are minimized, but also the effective power is reduced. These losses are compensated for simply by increasing the number of wheels at the same shallow depth. It should be noted that using one very wide bladed wheel will not achieve the same positive results as using multi-wheels spaced sufficiently apart. While the single wide bladed wheel is feasible, water enters a front longitudinal edge instead of the water entering the blades from side edges as with the multi-wheels. Hence, the greater the number of wheels the greater the access for water to enter the curved blades and thereby move a greater volume of water backwardly.

The water craft 60 has a boat hull 62 and a power transmission system 63 similar in construction to the boat hull and power transmission system found on the water craft 10 described with reference to FIGS. 1–6. However, an open frame 64 is greater in width to accommodate the four bladed wheels. As evident, the open frame has side rails 65 and 66 connected by a cross rail 67 at about right angles to each. Arcuate members (not shown) extend from side rails 65 and 66, respectively. A drive shaft 70 is mounted in bearing blocks and extends transversely and substantially horizontally across the open frame from side rail 65 to side rail 66. Also, an additional bearing block is provided in the approximate center of the shaft 70. Each wheel 71, 72, 73 and 74 is permanently mounted on the drive shaft 70 to rotate therewith. Sprocket wheels 75 and 76 are also mounted on the drive shaft and are driven by the power transmission system in a manner above described.

Each of the bladed wheels has blades with chords of about five inches to about seven inches. Each set of blades is spaced laterally from an adjacent set of blades by about five inches to about seven inches. In use, all four bladed wheels on the water craft 60 move in concert. The result is a very efficient use of the power provided by the individual.

In operation, the individual seats himself or herself in the boat hull operator's seat. Each foot is placed on a footrest. The individual needs only to push each footrest forwardly, preferably one at a time or, because of their independency, both at the same time. The elastic cord on the power transmission system pulls the footrest back towards the individual whereupon the individual pushes forward again. Power from these foot and leg movements causes the drive shaft to rotate and at the same time each bladed wheel on the drive shaft rotates. The water craft moves through the water as each rotating wheel causes its blades to force water backwardly and over the hydrofoil.

While not shown, it should be understood that other features found on pleasure water craft can be used on the water craft of this invention. For example, a rudder can be placed on the back of the open frame with a boom extending to the individual for steering purposes. Moveable vanes mounted on the underside of the boat hull and mechanically operated by the individual by a series of hand levers are another feasible steering means. A wheel cover can be positioned on the open frame of the assembly to prevent back spraying.

Having described the invention in its preferred embodiment, it should be clear that modifications can be made without departing from the spirit of the invention. It is not intended that the words used to describe the invention nor the drawings illustrating the same be limiting on the invention. It is intended that the invention only be limited by the scope of the appended claims.

What is claimed is:

1. A hydrofoil-bladed wheel assembly for attachment to a boat hull of a self-propelled water craft to effect efficient transfer of power from an individual in the water craft to propel the water craft through water at a relatively fast speed, said assembly comprising:

(a) an open frame with attachment means for securing said open frame to a stern of the boat hull;

(b) a drive shaft rotatably mounted on the open frame to extend transversely across the frame and transversely to a longitudinal axis of the boat;

(c) at least one wheel having a center axis and immovably mounted at its center axis to the drive shaft so as to rotate with said shaft, further each said wheel having a set of curved blades mounted on the wheel's periphery so as to move through the water during use, each said blade angled backwardly away from the boat hull; and (d) a hydrofoil mounted on the open frame so as to extend transversely across the open frame directly below each wheel and in operable association with the blades of each wheel whereby rotation of each wheel causes each blade to create a water flow guided by the hydrofoil to provide a forward propulsion force and to effect a lifting action of the boat hull in the water and allow said boat hull to move more quickly through the water.

2. The hydrofoil-bladed wheel assembly of claim 1 wherein from one to four wheels are mounted on the drive shaft.

3. The hydrofoil-bladed wheel assembly of claim 2 wherein each wheel with its curved blades has a blade tip diameter of from about eighteen inches to about twenty-one inches.

4. The hydrofoil-bladed wheel assembly of claim 3 wherein each wheel has from about twenty curved blades to about twenty-four curved blades substantially equi-spaced around the periphery of said wheel.

5. The hydrofoil-bladed wheel assembly of claim 1 wherein the hydrofoil has a chord of from about two inches to about five inches.

6. The hydrofoil-bladed wheel assembly of claim 2 wherein from two to four wheels are mounted on the drive shaft and further wherein the curved blades on each wheel have chords of from about five inches to about seven inches and wherein each set of curved blades on a wheel are laterally spaced about five inches to about seven inches from an adjacent set of curved blades on another wheel.

7. The hydrofoil-bladed wheel assembly of claim 6 wherein each curved blade on each wheel has a radius of from about three inches to about four inches.

8. The hydrofoil-bladed wheel assembly of claim 1 wherein each curved blade on the wheel has a backward angle of inclination of from about 20 degrees to about 30 degrees from a radii vector on the wheel.

9. The hydrofoil-bladed wheel assembly of claim 8 wherein each wheel is made of acrylic plastic and each curved blade is made of aluminum.

10. The hydrofoil-bladed wheel assembly of claim 1 wherein the drive shaft is mounted on bearing blocks.

11. A self-propelled water craft capable of quickly moving through water, said water craft comprising:

(a) a boat hull;

(b) an open frame with attachment means for securing said open frame to a stern of the boat hull;

(c) a drive shaft rotatably mounted on the open frame to extend transversely across the frame and transversely to a longitudinal axis of the boat;

(d) at least one wheel having a center axis and immovably mounted at its center axis to the drive shaft so as to rotate with said shaft, further each said wheel having a set of curved blades mounted on the wheel's periphery so as to move through the water during use, each said blade angled backwardly away from the boat hull;

(e) a hydrofoil mounted on the open frame so as to extend transversely across the open frame directly below each wheel and in operable association with the blades of each wheel; and (f) a power transmission system for transferring power from the individual in the water craft to the drive shaft whereby rotation of each said wheel causes each blade thereon to move water into contact with the hydrofoil to provide a forward propulsion force and to effect a lifting action of the boat hull in the water and allow said boat hull to move more quickly through the water.

12. The self-propelled water craft of claim 11 wherein each wheel with its curved blades has a blade tip diameter of from about eighteen inches to about twenty-one inches.

13. The self-propelled water craft of claim 12 wherein each wheel has from about twenty curved blades to about twenty-four curved blades substantially equi-spaced around the periphery of said wheel.

14. The self-propelled water craft of claim 11 wherein from two to four wheels are mounted on the drive shaft and further wherein the curved blades on each wheel have chords of from about five inches to about seven inches and wherein each set of curved blades on a wheel are laterally spaced about five inches to about seven inches from an adjacent set of blades on another wheel.

15. The self-propelled water craft of claim 14 wherein each curved blade on each wheel has a radius of from about three inches to about four inches.

16. The self-propelled water craft of claim 11 wherein each curved blade on the wheel has a backward angle of inclination of from about 20 degrees to about 30 degrees from a radii vector on the wheel.

17. The self-propelled water craft of claim 14 wherein the hydrofoil has a chord of from about two inches to about five inches and a lateral length of slightly greater than the total distance between outer lateral blade edges of two outermost wheels.

18. The self-propelled water craft of claim 17 wherein the vertical distance between a curved blade outside longitudinal edge and the hydrofoil is from about two inches to about three inches as measured when said blade's longitudinal edge is directly about the hydrofoil.

19. The self-propelled water craft of claim 11 wherein the power transmission system includes two linear foot slides mounted in the boat hull and independently operably connected to the drive shaft.

20. The self-propelled water craft of claim 19 wherein each of the linear foot slides has a foot rest and is operably connected to a free-wheeling sprocket wheel which is mounted on the drive shaft by a substantially inelastic cable, a sprocket chain and a substantially elastic cord wherein the sprocket chain has a length approximately equal to a stroke length and wraps around the free-wheeling sprocket wheel, the substantially inelastic cable is attached to the foot rest and one end of the sprocket chain and the substantially elastic cord is attached at one end to the other end of the sprocket chain and fixedly attached at its other end to the boat hull near the foot rest.

21. A hydrofoil-bladed wheel assembly for attachment to a boat hull of a self-propelled water craft to effect efficient transfer of power from an individual in the water craft to propel the water craft through water at a relatively fast speed, said assembly comprising:

(a) an open frame with attachment means for securing said open frame to a stern of the boat hull;

(b) a drive shaft rotatably mounted on the open frame to extend transversely across the frame and transversely to a longitudinal axis of the boat;

(c) at least one wheel having a center axis and immovably mounted at its center axis to the drive shaft so as to rotate with said shaft, further each said wheel having a set of curved blades mounted on the wheel's periphery so as to move through the water during use, each said curved blade having a constant curve and each said curved blade mounted on said wheel at a backward angle of inclination of about 20 degrees to about 30 degrees from a radius vector extending from the wheel's center axis; and (d) a hydrofoil mounted on the open frame so as to extend transversely across the open frame and to be in operable association with the blades of each wheel whereby rotation of each wheel causes each blade to create a water flow guided by the hydrofoil to provide a forward propulsion force and to effect a lifting action of the boat hull in the water and allow said boat hull to move more quickly through the water.

22. The hydrofoil-bladed wheel assembly of claim 21 wherein each of the curved blades has a radius of from about three inches to about four inches.

23. The hydrofoil-bladed wheel assembly of claim 21 wherein each wheel with its curved blades has a blade tip diameter of from about eighteen inches to about twenty-one inches.

24. The hydrofoil-bladed wheel assembly of claim 23 wherein each wheel has from about twenty curved blades to about twenty-four curved blades substantially equi-spaced around the periphery of said wheel.

25. The hydrofoil-bladed wheel assembly of claim 21 wherein the hydrofoil has a chord of from about two inches to about five inches.

26. The hydrofoil-bladed wheel assembly of claim 21 wherein from two to four wheels are mounted on the drive shaft and further wherein the curved blades on each wheel have chords of from about five inches to about seven inches and wherein each set of curved blades on a wheel are laterally spaced about five inches to about seven inches from an adjacent set of curved blades on another wheel.

27. A hydrofoil-bladed wheel assembly for attachment to a boat hull of a self-propelled water craft to effect efficient transfer of power from an individual in the water craft to propel the water craft through water at a relatively fast speed, said assembly comprising:

(a) an open frame with attachment means for securing said open frame to a stern of the boat hull;

(b) a drive shaft rotatably mounted on the open frame to extend transversely across the frame and transversely to a longitudinal axis of the boat;

(c) at least one acrylic plastic wheel having a center axis and immovably mounted at its center axis to the drive shaft so as to rotate with said shaft, further each said wheel having a set of curved aluminum blades mounted on the wheel's periphery so as to move through the water during use, each said blade angled backwardly away from the boat hull when the open frame is secured thereto; and (d) a hydrofoil mounted on the open frame so as to extend transversely across the open frame and to be in operable association with the blades of each wheel whereby rotation of each wheel causes each blade to create a water flow guided by the hydrofoil to provide a forward propulsion force and to effect a lifting action of the boat hull in the water and allow said boat hull to move more quickly through the water.

28. A self-propelled water craft capable of quickly moving through water, said water craft comprising:

(a) a boat hull;

(b) an open frame with attachment means for securing said open frame to a stern of the boat hull;

(c) a drive shaft rotatably mounted on the open frame to extend transversely across the frame and transversely to a longitudinal axis of the boat;

(d) at least one wheel having a center axis and immovably mounted at its center axis to the drive shaft so as to rotate with said shaft, further each said wheel having a set of curved blades mounted on the wheel's periphery so as to move through the water during use, each said blade angled backwardly away from the boat hull;

(e) a hydrofoil mounted on the open frame so as to extend transversely across the open frame and to be in operable association with the blades of each wheel; and (f) a power transmission system for transferring power from the individual in the water craft to the drive shaft whereby rotation of each said wheel causes each blade thereon to move water into contact with the hydrofoil to provide a forward propulsion force and to effect a lifting action of the boat hull in the water and allow said boat hull to move more quickly through the water, said power transmission system including two linear foot slides mounted in the boat hull and independently operably connected to the drive shaft, and further wherein each of the linear foot slides has a foot rest and is operably connected to a free-wheeling sprocket wheel which is mounted on the drive shaft by a substantially inelastic cable, a sprocket chain and a substantially elastic cord wherein the sprocket chain has a length approximately equal to a stroke length and wraps around the free-wheeling sprocket wheel, the substantially inelastic cable is attached to the foot rest and one end of the sprocket chain and the substantially elastic cord is attached at one end to the other end of the sprocket chain and fixedly attached at its other end to the boat hull near the foot rest.

* * * * *